US007631601B2

(12) United States Patent
Feldman et al.

(10) Patent No.: US 7,631,601 B2
(45) Date of Patent: Dec. 15, 2009

(54) SURVEILLANCE PROJECTILE

(76) Inventors: Paul H. Feldman, 103 Kingussie, Cary, NC (US) 27511; Matthew J. Ray, 8224 Round Oak Rd., Raleigh, NC (US) 27616; James F. McNulty, Jr., 1290 Third St., Calimesa, CA (US) 92320

( * ) Notice: Subject to any disclaimer, the term of this patent is extended or adjusted under 35 U.S.C. 154(b) by 547 days.

(21) Appl. No.: 11/154,845

(22) Filed: Jun. 16, 2005

(65) Prior Publication Data

US 2006/0283345 A1 Dec. 21, 2006

(51) Int. Cl.
*F42B 8/08* (2006.01)

(52) U.S. Cl. ..... 102/502; 89/1.11

(58) Field of Classification Search ..... 89/1.11; 102/473, 502, 513, 458, 501, 293
See application file for complete search history.

(56) References Cited

U.S. PATENT DOCUMENTS

| | | | | | |
|---|---|---|---|---|---|
| 2,406,816 | A * | 9/1946 | Elmer et al. | ..... | 369/156 |
| 3,721,410 | A | 3/1973 | Anspacher | | |
| 3,962,537 | A * | 6/1976 | Kearns et al. | ..... | 348/144 |
| 4,245,560 | A * | 1/1981 | Rambauske | ..... | 102/213 |
| 4,831,438 | A * | 5/1989 | Bellman et al. | ..... | 348/148 |
| 5,033,354 | A * | 7/1991 | Talkington | ..... | 89/1.1 |
| 5,181,673 | A * | 1/1993 | Hubricht et al. | ..... | 244/3.12 |
| 5,280,751 | A | 1/1994 | Muirhead et al. | | |
| 5,406,287 | A * | 4/1995 | Pinkus | ..... | 342/13 |
| 5,467,681 | A * | 11/1995 | Liberman | ..... | 89/1.11 |
| 6,119,976 | A * | 9/2000 | Rogers | ..... | 244/13 |
| 6,373,521 | B1 * | 4/2002 | Carter | ..... | 348/144 |
| 6,378,437 | B1 | 4/2002 | Burke, Jr. et al. | | |
| 6,764,041 | B2 | 7/2004 | Oron | | |
| 6,831,699 | B2 * | 12/2004 | Chang et al. | ..... | 348/373 |
| 6,880,467 | B1 * | 4/2005 | Knapp | ..... | 102/513 |
| 6,924,838 | B1 * | 8/2005 | Nieves | ..... | 348/211.99 |
| 6,978,717 | B1 * | 12/2005 | Hambric | ..... | 102/473 |
| 7,219,589 | B2 * | 5/2007 | Gibson et al. | ..... | 89/1.11 |
| 2002/0166442 | A1 * | 11/2002 | Sirmalis et al. | ..... | 89/1.11 |
| 2003/0011706 | A1 * | 1/2003 | Chang et al. | ..... | 348/375 |
| 2004/0036770 | A1 * | 2/2004 | Adams | ..... | 348/157 |
| 2004/0066451 | A1 * | 4/2004 | Schroth | ..... | 348/144 |
| 2004/0075585 | A1 * | 4/2004 | Kaiser et al. | ..... | 340/946 |

FOREIGN PATENT DOCUMENTS

| | | | |
|---|---|---|---|
| EP | 466499 | A1 * | 1/1992 |

* cited by examiner

*Primary Examiner*—Troy Chambers
(74) *Attorney, Agent, or Firm*—Ishman Law Firm P.C.

(57) ABSTRACT

A surveillance projectile consisting primarily of a very robust electronic device designed to be contained in a 40 mm cartridge that can be fired over distances through an open window or door and into a remote location, such as an enclosed site, where it is desirable to surreptitiously acquire intelligence by electronic means or by irradiating an interior with invisible infrared light to facilitate infrared sensing. The projectile may be configured to contain any of several types of surveillance devices. Such devices may be, but are not limited to, wirelessly operated cameras, audio transmitters, recorders and infrared illuminators. Audio transmission may be scrambled for decoding at a receiver.

4 Claims, 4 Drawing Sheets

SURVEILLANCE PROJECTILE

BACKGROUND OF THE INVENTION

1. Field of the Invention

The present invention relates to the general field of surveillance devices of the type delivered from a site location to a remote location to recover or provide tactical information regarding personnel, weapons, obstacles and objects at the remote location. The invention disclosed herein relates more specifically to a launched projectile containing a surveillance device such as a wirelessly operated camera, audio transmitter, voice recorder or infrared illuminator delivered to a remote location using a conventional launching device such as a 40 mm cartridge launcher.

2. Background Art

There are numerous issued U.S. Patents which relate to projectiles used for reconnaissance purposes. By way of example:

U.S. Pat. No. 3,721,410 to Anspacher discloses a reconnaissance system comprising a missile-type projectile having an infrared scan transducer for transmitting an image of an inaccessible target to a receiving station.

U.S. Pat. No. 3,962,537 to Kearns et al shows a similar system using a gun-fired projectile having a TV camera and a parachute for extending the time over a distant target.

U.S. Pat. No. 5,280,751 to Muirhead et al discloses a munition having an RF transmitter and a piezoelectric power supply which converts kinetic energy of the projectile to run the transmitter. The RF energy permits trajectory tracking and impact point location with high precision.

U.S. Pat. No. 5,467,681 to Liberman shows a cannon launched surveillance payload using a parafoil and towline to launch a reconnaissance device over a target for a longer period of time.

U.S. Pat. No. 6,378,437 to Burke, Jr. et al shows a subminiature telemetry and sensor system that is hardened to withstand extremely high G's and spin rates to report the parameters of a ballistic projectile.

U.S. Pat. No. 6,764,041 to Oron relates to a fuse for shells, missiles and the like and having an imaging sensor housed in a shock absorbing and spin suppressing fore end structure to survive firing from a cannon or the like for obtaining and transmitting reconnaissance images to a ground station.

None of these patents relate to a survivable projectile having a radio transmitter, TV camera, etc. for relating reconnaissance intelligence after launching into close quarters through a window or the like and having a power source initiated by launch of the projectile and designed to transmit radiant energy from a stationary location after launch.

Such a device can be highly advantageous for use by police agencies in hostage situations or by military personnel to acquire tactical intelligence to fight insurgencies or terrorist groups.

SUMMARY OF THE INVENTION

The present invention comprises a surveillance projectile consisting primarily of a very robust electronic device designed to be contained in a 40 mm cartridge that can be fired over distances through an open window or door and into a remote location, such as an enclosed site, where it is desirable to surreptitiously acquire intelligence by electronic means such as a video camera, recorder, still camera, an audio transmitter or the like or by irradiating with invisible infrared light to facilitate infrared sensing. The infrared light might also irradiate quarters to which grid power has been cut to enhance infrared sensing during hostage extractions or room-to-room searches, raids and/or assaults occurring during urban policing or warfare or to enhance night vision viewing of unlighted battlefields. 250 mW circuits capable of transmitting electromagnetic radiation to a distance of at least ¼ mile can be comfortably housed within and launched from ammunition cartridges with diameters of 40 mm or less and lengths of 5 inches or less. The projectile may be configured to contain any of several types of surveillance devices. Such devices may be, but are not limited to, wirelessly operated cameras, audio transmitters (with or without scramble), recorders and infrared illuminators. Two different projectile shell configurations are disclosed herein. One is a spherical container which is supported in a cylindrical sabot with a hemispherical well. The spherical projectile shell and its sabot are retained in a conventional cylindrical shell or cartridge case that uses a blank ammunition round to propel the projectile toward a target enclosure or the like. The other disclosed projectile shell is of an oblong configuration having a cylindrical center section and hemispherical ends. Both have foam rubber protective inserts to protect interior electronics and preferably include a normally open switch which closes only after the projectile separates from its sabot or casing after launch to activate the electronics and thus conserves battery power until actual launch. Some or all of the shell may be light transmissive for infrared sensing.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF PREFERRED EMBODIMENTS

Figure 1:
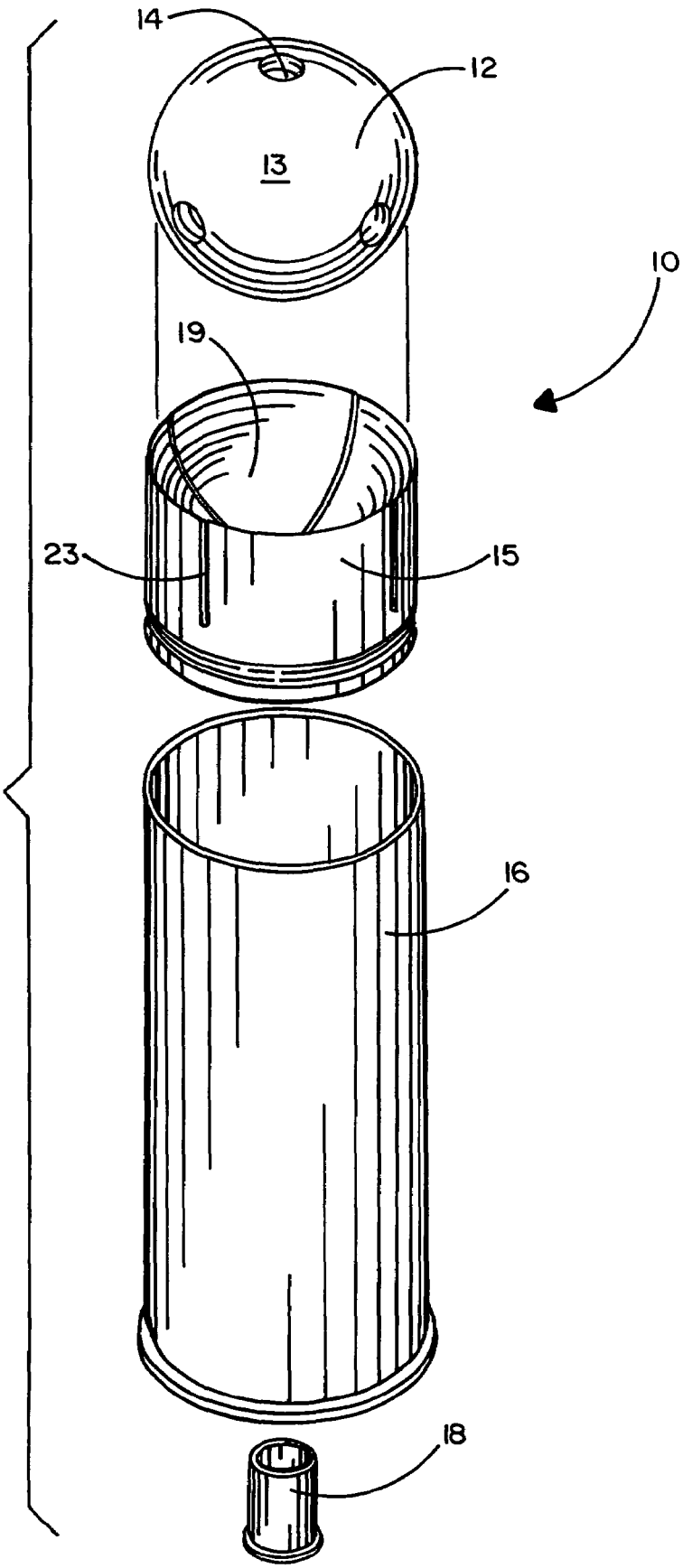
FIG. 1 is an exploded view of a surveillance projectile sabot and cartridge and ammunition round in accordance with a first embodiment of the present invention.
Figure 2:
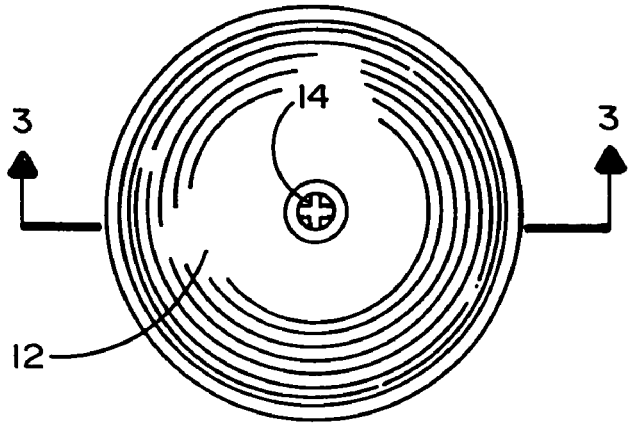
FIG. 2 is a top view of the assembled projectile of FIG. 1.
Figure 3:
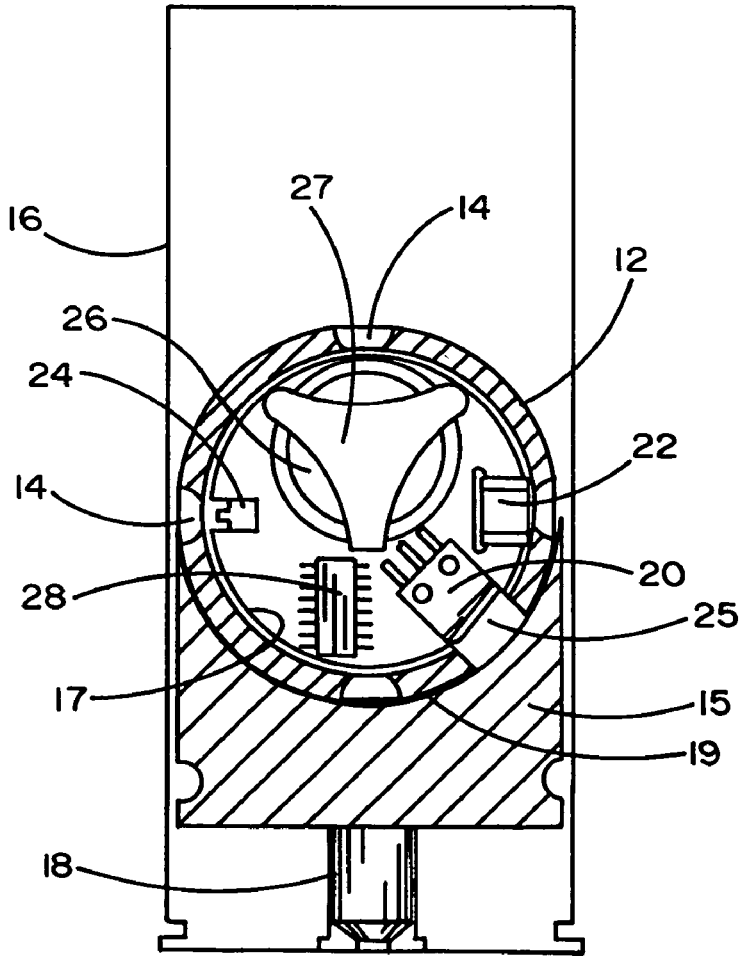
FIG. 3 is a cross-section view taken along lines 3-3 of FIG. 2.

Referring to the accompanying drawings and particularly to FIGS. 1-3, it will be seen that a surveillance projectile assembly 10 comprises a spherical projectile shell 12, a sabot 15, an ammunition cartridge 16 and an ammunition round 18. Projectile 12 is a hollow body having a plurality of apertures 14 extending from the outer surface 13 into an interior cavity 17 as shown in FIGS. 2 and 3. Sabot 15 is a cylindrical body having a hemispherical recess 19 for receiving projectile 12 as shown in FIGS. 1 and 3. Cartridge 16 is, in the illustrated embodiment, a 40 mm cartridge case and round 18 is a 0.36 caliber blank ammunition round. As shown in FIG. 3, when fully assembled for launch by a suitable launcher, the spherical projectile 12 sits in the recess 19 of sabot 15 within cartridge 16 immediately above round 18.

Figure 4:
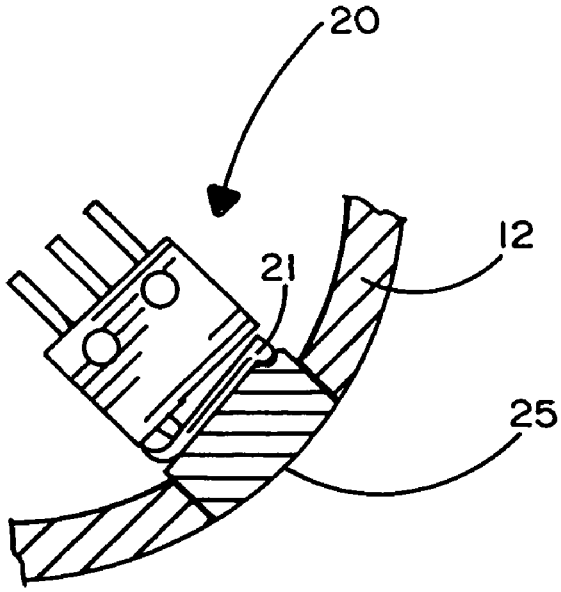
FIG. 4 is an enlarged view of an activation switch used in the preferred embodiment and shown in its normally open position just prior to activation.
Figure 5:
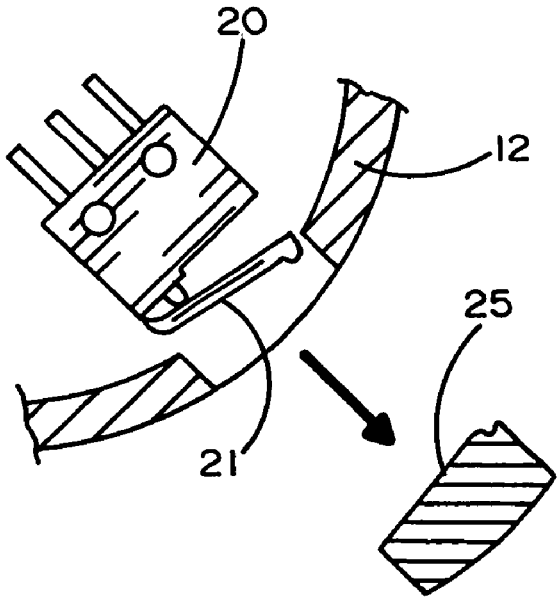
FIG. 5 is a view of the activation switch similar to FIG. 4 but shown in its normally closed position.

The projectile shell 12 houses within its interior cavity 17 various surveillance electronic devices including for example, a video camera 22, a microphone 24, a battery 26, a transmitter 27 and control electronics 28. Of particular significance is an activation switch 20. As shown in FIGS. 4 and 5, switch 20 has an arm 21 which rests against a switch follower 25 in a switch-open position. The switch 20 separates during projectile flight from its follower 25 thereby allowing arm 21 to release into the switch-closed position of switch 20 which connects battery 26 to the remaining electronics inside projectile 12 so that by the time it impacts at its intended target location, projectile 12 is activated for surveillance operation.

The projectile launch sequence operates in a conventional manner which is well known in the art of large caliber firearms. Suffice it to say that after launch, the projectile 12 and sabot 15 exit the cartridge 16 and then separate from each other in the course of their respective ballistic trajectories due to differences in their aerodynamic characteristics which are amplified by sabot crevices 23 shown in FIG. 1. It is separation of the projectile from the sabot that permits the switch follower 25 to fall away from the projectile and thus allow the spring biased switch arm 21 to rotate into a switch-closed position thereby closing switch 20 and activating the projectile's electronics.

Figure 6:
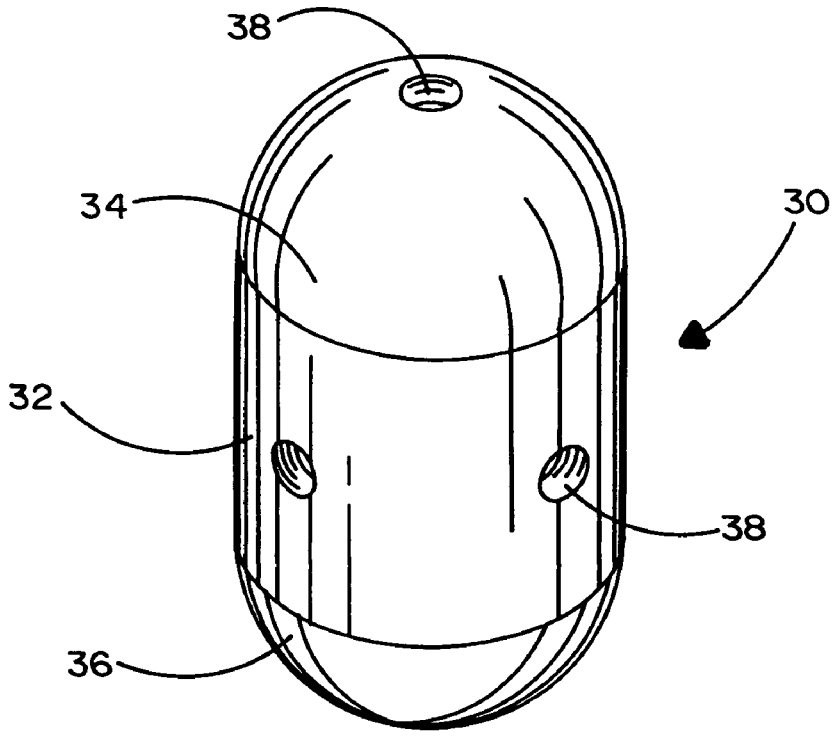
FIG. 6 is a three-dimensional view of an alternative embodiment of a projectile shell for use in the present invention.
Figure 7:
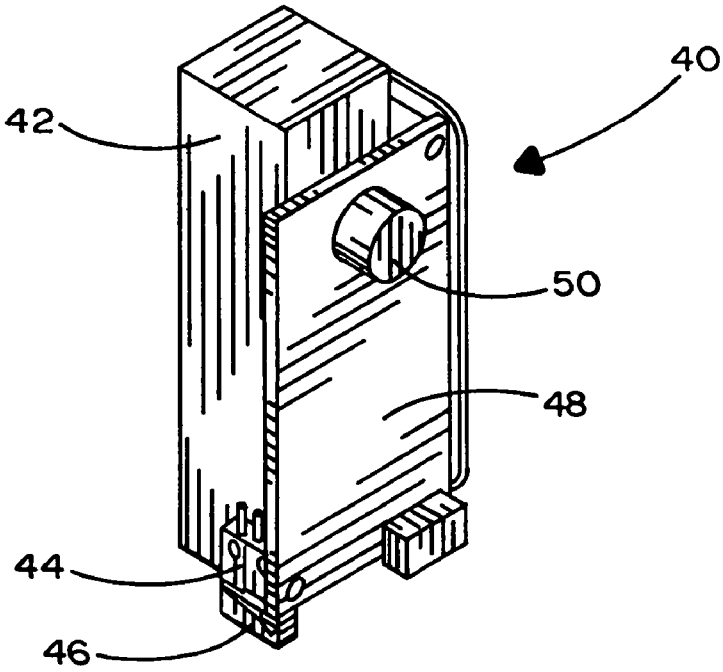
FIG. 7 is a view of an electronics module comprising surveillance device and high power battery for use with the projectile of FIG. 6.

FIGS. 6 and 7 illustrate an alternative embodiment of projectile and projectile-contained electronics. More specifically, as shown in FIG. 6, an oblong shaped projectile shell 30 comprises a cylindrical center section 32 and hemispherical end sections 34 and 36. A plurality of apertures 38 provide paths directly into a hollow interior which contains surveillance device 40 shown in FIG. 7. Device 40 includes a high capacity battery 42 as well as switch 44 and switch follower 46. The remaining electronics are mounted on the battery side of PCB 48 and include for example microphone 50 which extends through PCB 48 as shown in FIG. 7.

Apertures 14 of projectile shell 12 and apertures 38 of projectile shell 30 provide multiple sensory paths for microphones and cameras contained in their respective projectiles and assure that some such paths will remain unobstructed regardless of the impact orientation of the projectile. Microphones, cameras and infrared lights may also be flush mounted at the surface of the shell.

Having thus disclosed alternative embodiments of the invention, it will now be apparent that numerous modifications may be made. By way of example, the precise shape and size, as well as the kinds of surveillance devices contained within a suitable projectile, may be readily altered depending upon the tactical requirements and launch mechanism of the invention. By way of example, an infrared illuminator contained within a fully or partially translucent or transparent projectile shell or in an opaque shell having translucent passages for transmitting infrared light to the exterior, is also contemplated herein. Accordingly, the scope hereof shall be limited only by the appended claims and their equivalents and not by the examples disclosed herein.

We claim:

1. A surveillance projectile for wireless surveillance at a stationary location remote to a launch site, the projectile assembly comprising:

an ammunition cartridge including a cylindrical side wall and a transverse circular base wall forming an outwardly opening cavity;

an ammunition charge carried on said base;

a projectile assembly carried in assembly in said cavity of said cartridge, said projectile assembly having an interior cavity carrying a surveillance device providing a surveillance function at said location, said device connected to a power supply controlled by a normally on switch having an actuating arm, an aperture in said projectile assembly registering with said actuating arm, a follower member received in said aperture engaging said actuating arm to establish an off condition in assembly, said follower member being released from said aperture after launch of said projectile assembly whereby said actuating arm moves to a normal position to establish an on condition thereby supplying power from said power supply to said surveillance device enabling the surveillance function thereof.

2. The surveillance projectile as recited in claim 1 wherein said projectile assembly includes a spherical housing enclosing said surveillance device and carried in a hemispherical depression in a sabot.

3. The surveillance projectile as recited in claim 2 wherein said follower member engages said sabot, said sabot separating from said housing after launch thereby releasing said follower member from said aperture and permitting movement of said actuating arm to said normal position.

4. The surveillance projectile as recited in claim 3 wherein said surveillance device is selected from the group consisting of video devices, recording devices, audio devices and illuminating devices.

* * * * *